United States Patent [19]

Holmgren

[11] Patent Number: 4,682,453

[45] Date of Patent: Jul. 28, 1987

[54] FLOOR CONSTRUCTION SUITABLE FOR INSTALLATION IN ROOMS CONTAINING SWITCHGEAR, COMPUTERS, AND LIKE ELECTRICAL APPARATUS, AND A METHOD FOR PRODUCING SUCH A FLOOR CONSTRUCTION

[76] Inventor: Klas Holmgren, Tulegatan 45, 113 53 Stockholm, Sweden

[21] Appl. No.: 782,730

[22] Filed: Oct. 1, 1985

[30] Foreign Application Priority Data

Oct. 2, 1984 [SE] Sweden ..... 8404923

[51] Int. Cl.[4] ..... E04B 5/48

[52] U.S. Cl. ..... 52/126.2; 52/126.5; 52/477

[58] Field of Search ..... 52/126.2, 126.5, 263, 52/586, 660, 664, 669, 475–477

[56] References Cited

U.S. PATENT DOCUMENTS

| | | | |
|---|---|---|---|
| 764,949 | 7/1904 | Krebs | 52/669 |
| 3,310,922 | 3/1967 | Hoffman | 52/664 |
| 3,881,286 | 5/1975 | Smith | 52/664 |
| 3,979,871 | 9/1976 | Pollock | 52/664 |
| 4,169,688 | 10/1979 | Toshio | 52/586 |
| 4,326,366 | 4/1982 | Werner | 52/220 |
| 4,531,564 | 7/1985 | Hanna | 52/586 |

FOREIGN PATENT DOCUMENTS

| | | | |
|---|---|---|---|
| 526266 | 2/1954 | Belgium | 52/664 |
| 2433100 | 1/1976 | Fed. Rep. of Germany | 52/664 |
| 699051 | 2/1931 | France | 52/126.5 |

OTHER PUBLICATIONS

ASEA brochure; Jun. 1983.

Donn Scandinavia brochure; Jun. 1983.

*Primary Examiner*—James L. Ridgill, Jr.

*Attorney, Agent, or Firm*—Burns, Doane, Swecker & Mathis

[57] ABSTRACT

A floor construction, suitably for use in rooms containing electrical switchgear, computers and like apparatus, comprises a plurality of mutually parallel, elongated and longitudinally extending first joists (8,9), and a plurality of mutually parallel, elongated, transversely extending second joists (12,13,14,15) extending at right angles across the first joists (8,9). The joists define one or more square and/or rectangular cavities, which are covered by one or more right-angled slabs (7,7',7''). These slabs form the surface of the floor and are dimensioned so as to be supported along the whole of their edge portions by the upper surfaces of adjacent joist sections.

The elongated, longitudinally extending first joists (8,9) are provided with a plurality of first recesses (20) spaced at a given distance apart. These first joists (8), of reduced flexural resistance, are arranged to lie on a supporting foundation. The elongated, transversely extending second joists (12) are provided with a plurality of second recesses (21) spaced at a given distance apart. The transversely extending joists (12) of reduced flexural resistance are arranged to rest on the longitudinally extending joists (8) or the foundation (1). A first recess (20) located in a longitudinally extending joist (8) is arranged to co-act with a second recess (21) in a transversely extending joist (12) so as to locate the upper surface (22) of the longitudinally extending joist (8) and the upper surface (23) in the transversely extending joist (12) in one and the same plane. At least one slab (7) is provided with means for locking the slab against movement in a plane relating to the upper surfaces of the joists. The means (41) provided on the slab (7) is also arranged to lock the longitudinally extending and transversely extending joists (8,12) at right angles to one another and parallel with one another.

8 Claims, 9 Drawing Figures

FLOOR CONSTRUCTION SUITABLE FOR INSTALLATION IN ROOMS CONTAINING SWITCHGEAR, COMPUTERS, AND LIKE ELECTRICAL APPARATUS, AND A METHOD FOR PRODUCING SUCH A FLOOR CONSTRUCTION

TECHNICAL FIELD

The present invention relates to a floor construction, and particularly, although not exclusively, to a floor construction which can be used to advantage in rooms which contain electrical switchgear, computers and like apparatus, and which can be referred to as an "intermediate" floor construction or a "false" floor construction, since said floor construction constitutes an auxiliary floor structure placed above and in spaced relationship with a conventional floor or supporting joist structure, so as to define an intermediate space which extends horizontally in all directions, to enable primarily conduits and conductors for conducting electric current and electric signals to be laid selectively therein, and secondarily conduits for conducting air and water beneath the false floor structure.

The floor construction according to the present invention also facilitates the removal of moisture and/or collections of moisture in the underlying structure by ventilation.

A floor construction of this kind comprises a plurality of mutually parallel, elongated and longitudinally extending first joists, and a plurality of mutually parallel elongated second joists each of which extends at right angles to the longitudinally extending first joists. One or more of the mutually perpendicular joists thus define square or rectangular cavities, which are covered with one or more load-supporting slabs forming the surface of the floor.

These slabs are arranged and dimensioned for support around all four sides thereof against the upper surfaces of adjacent joists. The invention also relates to a method for constructing a floor structure suitable for use in rooms which contain electric switchgear, computers and like apparatus.

BACKGROUND ART

Many different kinds of such floor constructions are known to the art.

One example of such known floor constructions is an installation floor retailed under the designation Modell 10 and 15 by "Donn Scandinavia", Sigtuna, Sweden. This known floor construction comprises a plurality of spot footings provided with adjustable lock nuts for making vertical height adjustments, these spot footings being placed so that the corners of each slab forming a floor surface rest on four of said footings. Each of these slabs comprises a high-density intermediate laminated body having heat-galvanized metal plates fixed to the top and bottom surfaces thereof, in order to provide a self-supporting and load-bearing slab. In addition, it is necessary to strengthen the edges of the slabs with the aid of a U-section sunk into the edges of the slab. The slabs can be provided with a surface covering of synthetic resin laminates, vinyl squares, needle felt or some other soft covering material.

In order to be able to reduce the load-bearing requirements of the slab per se, so that weaker slabs can be used, it has been proposed that short joists are arranged between mutually adjacent spot footings, such that a group of four joists will form a support for the four edge portions of a slab. Each such short joist must be attached or fastened at its end surfaces to a respective spot footing.

Another known floor construction of this kind is one sold by ASEA, Västerås, Sweden, under the designation KAFAK HELLANGOLV. This floor construction comprises a plurality of mutually parallel elongated, longitudinally extending first joists and a plurality of mutually parallel second joists similar to said first joists and extending at right angles thereto, the mutually perpendicularly extending and mutually intersecting first and second joists defining square and/or elongate rectangular cavities which are covered by a single floor slab or a plurality of floor slabs. These slabs are arranged and dimensioned so that two mutually opposing side edges of a slab rest against and are supported by the upper surfaces of the edge sections of adjacent joists.

The longitudinally extending joists are supported on vertically adjustable spot footings.

SUMMARY OF THE PRESENT INVENTION

TECHNICAL PROBLEM

With respect to the present state of the art, it will be seen that one technical problem resides in providing a floor construction of the aforesaid kind in which the complete floor structure can be constructed in a simple manner by placing joists of reduced bending strength onto a supporting foundation and therewith produce a floor structure which consumes far less material than prior art constructions of this kind, without detracting from the good stability and high mechanical strength required of the slabs.

Another technical problem with regard to such floor structures is one of providing elongated, longitudinally extending first joists and elongated, transversely extending second joists which are so shaped and formed that they are able to co-act with one another at right angles in a manner such that the upper surfaces of respective first and second, mutually intersecting joists lie in one and the same horizontal plane, therewith enabling a thin slab to be supported on four support surfaces acting at the edge regions of the slab.

A further technical problem is one of providing simple ways and means which enable a slab to be locked against movement in a plane related to the upper surfaces of respective joists, while nevertheless enabling a slab to be readily lifted vertically from the underlying joists, out of contact therewith.

Still another technical problem in this regard is one of providing conditions whereby a slab provided with said means for preventing movement of the slab in a horizontal plane related to the upper surfaces of respective joists is also able to lock the joists in positions in which they lie mutually at right angles and parallel with one another.

In respect of the joists used, it will be seen that a technical problem exists in providing first, longitudinally extending joists of one particular configuration and second, longitudinally extending joists of another configuration such that the first and second joists are able to co-act readily with one another, even when the joist length considerably exceeds the total horizontal extension of a number of juxtaposed slabs.

Another technical problem in floor structures of the aforesaid kind is one of enabling the longitudinally extending first joists and the transversely extending second joists to be given precisely the same configuration, i.e. by forming first and second mutually co-acting recesses therein.

A further technical problem in this regard is one of providing ways and means which enable the longitudinally extending first joists and the transversely extending second joists to be provided in a rational manner with third recesses which form channels through which pipes, electrical cables and like elements can be drawn, and in which the said third recesses can be formed in one edge part of a joist, preferably the upwardly facing edge part thereof, so as to enable the pipes, cables etc., to be laid, moved and dismantled in a ready and simple manner.

Still another technical problem associated with floor constructions of the aforesaid kind is one of enabling the joist to be formed from sheet-metal bent to the shape of a right-angled "U", while still enabling the joists to co-act with one another in the aforesaid manner.

Another difficulty in such constructions is one of perceiving that a recess milled in the edge region of a slab may form means for preventing movement of the slab along the joists, and that this milled recess or flange can be caused to rest against the uppermost edge surface of a joist, or that a slot or groove can be formed adjacent the edge surface of the slabs and along said edge surface, or alternately that one or more slots or grooves can be formed transversely of said edge surface, in a manner which enables these slots or grooves to co-operate with the edge of a joist or an associated insert plate in a manner to lock the floor-structure together.

It will be seen that a further technical problem is one of enabling a floor structure of the aforesaid kind to be constructed in a manner which affords a highly stable installation even when underdimensioning the floor-surface forming slabs with regard to their mechanical strength in comparison with prior art techniques where heavy "rolling" punctiform loads transversely of the slab joins imply a local and momentary critical loading of the slab joins, and even when similarly underdimensioning the joists strengthwise when said joists do not need to be load-bearing.

Another technical problem is one of eliminating the need for vertically adjustable, expensive spot footings in floor constructions of the aforesaid kind.

A further technical problem is one of being able to place a floor structure extremely close to a support foundation, and in all events much closer than the lowest construction height afforded by the aforesaid spot footings, while still leaving room for the aforesaid necessary channeling.

Yet another technical problem is one of producing a floor installation so constructed that slabs and the underlying support-frame formed by said joists can be cut or divided so as to conform to existing walls and wall-lines which do not register with a complete floor surface or a complete supporting-frame module.

A technical problem also lies in the provision of a floor construction which will be stable without needing to fasten spot footings to a supporting foundation and/or to support the support-frame against surrounding walls.

A further technical problem is one of devising a floor construction which can be installed, i.e. lain and adjusted, relatively quickly by unskilled personnel.

Another technical problem is one of devising a floor construction in which vertical channeling through the slabs can be effected at any selected location thereon, even in the region of the slab joins and at corner locations.

A further technical problem is one of being able to install a floor structure of the aforesaid kind in which the load to which the floor is subjected is not transferred to the underlying support foundation in the form of punctiform loads via spot footings, but in which the load is distributed over a supporting framework or studwork.

Another technical problem is one of constructing a floor installation of the aforesaid kind capable of supporting a partition wall while retaining the channeling intact beneath said wall.

It will be seen that a further technical problem is one of providing a floor construction having a self-stabilizing support frame work which incorporates joists placed on edge, so as to obtain maximum lateral stability at the corner locations of the joists and therewith also at the corner locations of the slabs.

A further technical problem is one of providing a floor construction in which the slabs can be produced by simply dividing standard slabs and in which the slabs can be used without requiring additional reinforcement.

Still another technical problem prevailing with floor constructions of the aforesaid kind is one of readily providing a supporting foundation which is sufficiently flat to take-up forces exerted through the overlying joists of reduced mechanical strength.

SOLUTION

The present invention thus relates to a floor construction which is suitable for installation in rooms containing switchgear, computers, and like electrical apparatus and which comprises a plurality of mutually parallel, elongated longitudinally extending first joists and a plurality of mutually parallel, elongated second joists which extend transversely to the first joists at right angles thereto, one or more of the longitudinally extending first joists and transversely extending second joists defining square and/or elongate rectangular cavities which are covered by one or more right-angled slabs serving as the floor surface. The slabs are arranged and dimensioned so as to be supported along their edge regions by adjacent edge regions of the upper surfaces of respective joists.

In accordance with the invention the elongated, longitudinally extending first joists are provided with a plurality of first recesses which are mutually spaced at given distances apart, these joists of reduced flexural resistance being arranged to rest against a supporting foundation. The elongated transversely extending second joists are provided with a plurality of second recesses which are mutually spaced at given distances apart, these second joists of reduced flexural resistance being arranged to rest against the longitudinally extending first joists and/ or the underlying supporting foundation.

A first recess in one longitudinally extending joist is intended to co-act with a second recess in a transverse joist, so that the upper surfaces of the two joists lie in the same horizontal plane.

This enables all four edge parts of a right-angled slab to rest on upper surfaces of four joists in a common horizontal plane. At least one slab is provided with means for locking the slab against lateral movement in a plane relating to the upper surfaces of the joists, these locking means being arranged so as to be able to lock longitudinally extending and transversely extending joists in mutually perpendicular and parallel positions. Such locking means, however, shall not prevent a slab from being lifted vertically from the joists.

In accordance with one advantageous embodiment of the invention, the longitudinally extending first joists are provided with a plurality of outwardly open first recesses, while the transverse joists are provided with a plurality of downwardly open second recesses. In accordance with a further embodiment, both the first and the second joists are identically formed.

The longitudinally extending first joist and/or the transversely extending second joist are provided with the third recesses intended for forming channels through which pipes, electric cables and the like can be drawn. These third recesses are conveniently formed in one edge portion of a joist, preferably in an upwardly facing edge portion thereof, so that the channel formed is fully exposed when slabs are removed and fully closed when the slabs are in position on the joists.

According to another advantageous embodiment of the invention, the joists are formed from metal-plate bent to the shape of a right-angled "U", with the legs of the U extending vertically upwards. In this case the aforesaid first and second recesses comprise two parallel slots oriented at a distance corresponding to the distance between the legs of the U-shaped section.

The means provided on the slab for preventing horizontal movement thereof in relation to the upper surfaces of a joist is conveniently given the form of a lip or flange milled in the bottom surface of the edge region of said slab. In this respect, a groove or slot may be formed adjacent to and along said bottom surface of said edge region, or alternatively one or more grooves or slots may be formed transversely of the edge region. These grooves can either be caused to co-act with a joist edge or with an insert plate attached to the upper surface of a joist.

When the joists have the form of U-shaped sheet-metal sections, it is proposed that the joists are provided with additional slots for co-acticn with the edges of joist-stiffening plates or like members. These stiffening plates or like members may extend fully across an associated joist and there serve to form a part for co-action with the aforesaid means effective to hold a slab against horizontal movement across the upper joist surfaces.

When the joists are made from a solid, homogenous material, such as wood or a wood-fibre composite, the upper surfaces of the joists present mutually parallel slits which may extend along the joists or across the same and in which a plate or like member can be inserted. In this case, the extension of the insert plate is preferably greater than the corresponding extension of the associated joist, so that a protruding part of the plate is able to co-act with a groove or slot formed in the undersurface of the slab.

The invention also relates to a method of laying a floor structure of the aforementioned kind. When putting the method into practice, a plurality of elongated, longitudinally extending first joists are placed in parallel relationship on a supporting foundation, said joists having a length which exceeds the span of a given number of juxtaposed slabs, and each of said joists having provided therein a plurality of mutually spaced, upwardly facing first recesses. Subsequent to laying the first joists in position on the supporting foundation, a plurality of elongated second joists having a length greater than a given number of juxtaposed slabs are placed in mutually parallel relationship across the first joists at right angles thereto, each of said transverse second joists being provided with mutually spaced, downwardly facing second recesses, such that the first recesses in the longitudinally extending first joists co-act with the second recesses in the transversely extending second joists, so that the upper surfaces of respective first and second joists lie in one and the same horizontal plane.

Subsequent hereto right-angled slabs are placed on the joists structure thus formed, with the four corner parts of respective slabs resting on said upper surfaces, said slabs being caused to co-act with locking means effective between the slabs and joists to prevent horizontal movement of the slabs along the joists and to lock the joists in a vertical position and in parallelity with adjacent joists.

It also lies within the concept of the invention to level the slab-supporting framework of longitudinally and transversely extending joists horizontally by:

(a) placing wedges beneath the longitudinally extending first joists and/or the transversely extending second joists, particularly solely longitudinally extending joists and/or (b) constructing a free-bearing underlying studwork which is dimensioned to absorb load and the joists of which are oriented in the same manner, or substantially the same manner as the longitudinally extending and transversely extending joists of the slab-supporting framework, and/or (c) smoothing out existing supporting surfaces, for example with mortar or self-levelling floor compound, either locally beneath and/or along the joists or over the whole of the supporting foundation.

ADVANTAGES

The advantages afforded by a floor construction according to the present invention primarily lie in the fact that the floor construction forms an extremely suitable installation floor and fulfils substantially all strength requirements placed on such floor structures, despite comprising fewer structural components, therewith enabling the structure to be greatly underdimensioned and simplified in relation to prior known floor structures of this kind.

The method according to the invention has the advantage of reducing the amount of work required to instal floor structures of this kind.

The main characteristic features of a floor construction according to the invention are set forth in the characterizing clause of the following claim 1, while the main characterizing features of a method for constructing a floor structure according to the present invention are set forth in the characterizing clause of the following claim 11.

BRIEF DESCRIPTION OF THE DRAWINGS

A number of embodiments of a floor construction according to the invention will now be described in more detail with reference to the accompanying drawings, in which.

DESCRIPTION OF THE BACKGROUND ART

Figure 1:
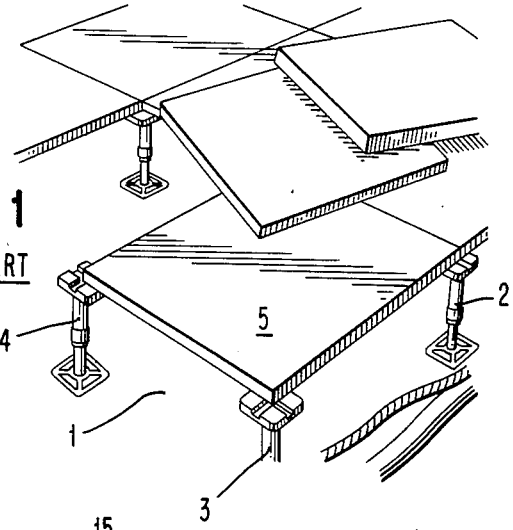
Fig. 1 PRIOR ART
FIG. 1 is a perspective view of a first embodiment of a known floor construction.

In FIG. 1 there is illustrated a first embodiment of a prior art floor construction which can be used in rooms in which electrical switchgear, computers and like apparatus are installed and which is designated an "installation" floor or a "false" floor and which constitutes an additional floor arranged above a normal floor construction, so as to define an intermediate space between a conventional floor construction 1 and the installation floor 5, this intermediate space being open horizontally in all directions, so as to enable electrical conduits, pipes and the like to be placed therein.

The floor construction is supported on a plurality of supports, of which three, 2,3 and 4, are shown. The supports, or spot footings, are provided with adjustable locking nuts and the slabs resting on the supports, of which one slab is referenced 5, are supported solely by the supports in four corners of the slab. In order to give the slabs 5 sufficient strength, it is necessary to manufacture the slabs from cold-rolled steel plate, which is formed into a beam system in both directions and welded to a hardened steel plate.

When the floor structure is expected to support extra heavy loads, it is suggested that the slabs 5 are supported along four edge portions on short joists or beams extending between the spot footings 2,3 and 3,4 etc..

Figure 2:
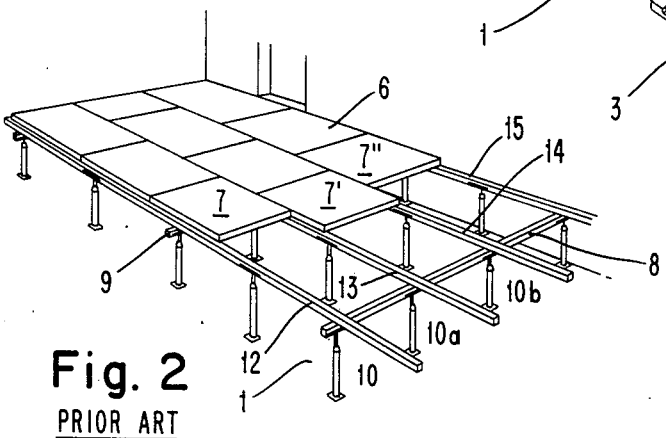
Fig. 2 PRIOR ART
FIG. 2 is a perspective view of a second embodiment of a known floor construction.

FIG. 2 illustrates a second embodiment of a known floor construction suitable for use as an installation floor in rooms in which electric switchgear, computers and like apparatus are installed.

This known floor construction also utilizes a standard floor structure 1 as a means of supporting a plurality of of slabs 7,7' and 7'' positioned above the surface of the floor.

The floor construction illustrated in FIG. 2 comprises a plurality of mutually parallel, elongated, longitudinally extending first joists, of which two are referenced 8 and 9, the joists 8 being supported by vertically adjustable supports or spot footings 10,10*a*, 10*b*. The joist 9 is supported in a similar manner by spot footings 11, 11*a*.

The known floor construction also comprises a plurality of mutually parallel, elongated second joists 12,13,14 and 15 which extend transversely, at right angles to each of the longitudinally extending first joists. The longitudinally extending first joists and the transversely extending second joists form square and/or elongate rectangular cavities, these cavities being duly covered by one or more slabs 7,7',7'' forming the floor surface. These slabs are positioned and dimensioned so that mutually opposing edge sections thereof are supported by the edge portions of adjacent joists, i.e. the joists 12,13 in respect of the slab 7, the joists 13,14 in respect of the slab 7' and the joists 14,15 in respect of the slab 7''.

DESCRIPTION OF A PREFERRED EMBODIMENT

Figure 3:
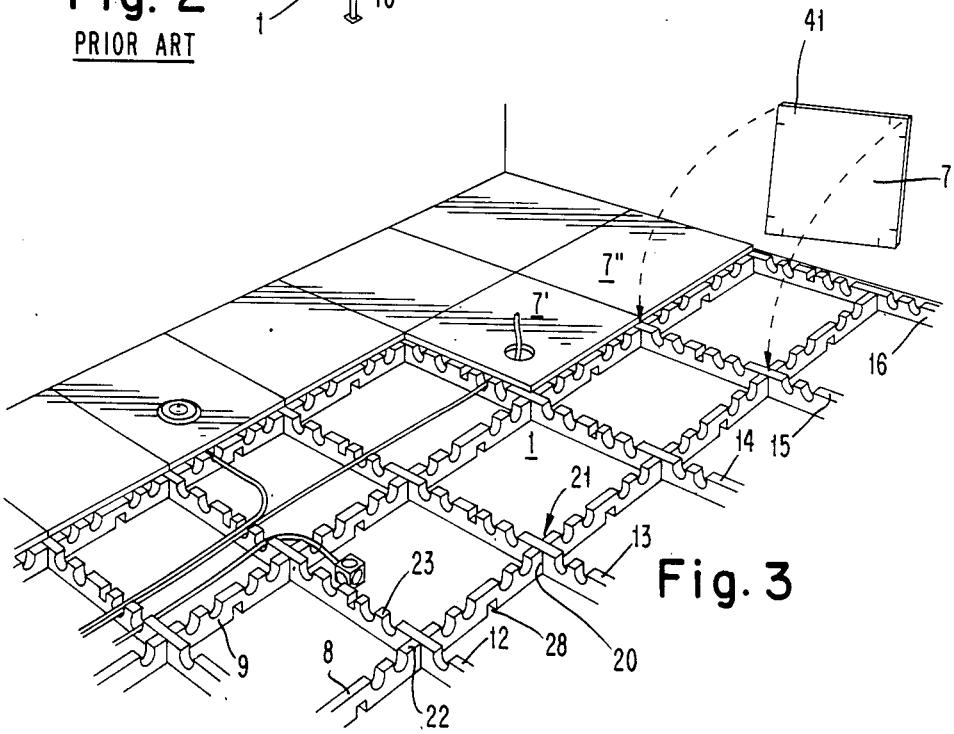
FIG. 3 is a perspective view of a floor construction according to the present invention.

FIG. 3 illustrates in perspective a floor construction in accordance with the invention, comprising a plurality of mutually parallel, elongated, longitudinally extending first joists 8,9, and a plurality of elongated, mutually parallel second joists 12,13,14 and 15 which extend transversely, at right angles to the longitudinally extending first joists 8,9. One or more parts of the mutually perpendicular longitudinally extending and transversely extending joists form square and/or rectangular cavities which are covered by one or more slabs 7,7' and 7'' forming the floor surface; the slab 7 in FIG. 3 is shown lifted from the joists, to illustrate the bottom surface of the slab. Each slab is arranged and dimensioned to be supported along the whole of its edge portions on adjacent half edge portions or upper surfaces of the joists, which are fully resistent to bending. The slabs may be 600×600 mm square.

Figure 4:
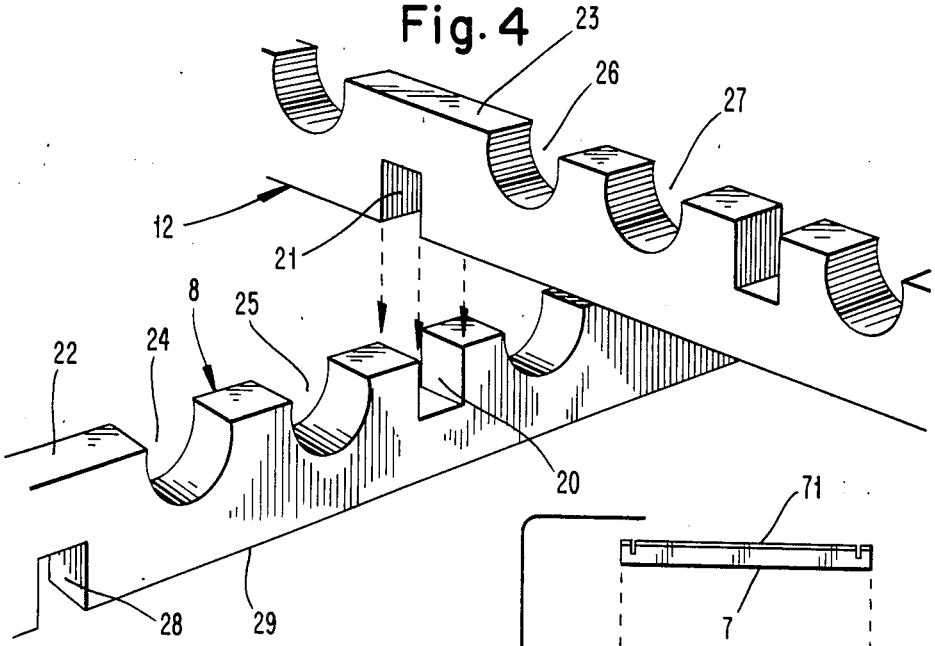
FIG. 4 illustrates the principle co-action according to the invention between elongated, longitudinally extending joists and elongated, transversely extending joists, seen from above.

The elongated, longitudinally extending first joists, of which one referenced 8 is illustrated in FIG. 4 is provided with a plurality of recesses 20 which are spaced at a given distance apart (the length of the slab). The joist 8 thus has a reduced resistance to bending, and consequently should not be free-supporting over any appreciable distance, but should instead rest directly on a supporting foundation 1. This foundation shall thus be capable of supporting loads, and may either comprise an existing, flat and horizontal floor structure or a flat horizontal joist structure or studwork rigid against bending forces.

This load-carrying foundation structure may also be permitted to be slightly uneven and/or out of horizontal, since subsequent measures can be taken to achieve the degree of levelness desired.

As a result of the said first recesses 20 and said second recesses 21, and also third recesses 24,25 and 26,27 formed in respective first and second joists 8, 12, the joists will have a considerably reduced resistance to bending forces. Consequently, these joists should not be free-supporting along any appreciable part of their lengths, i.e. along more than half or a third of the length of the slab 7.

Consequently, these joists, interconnected to form a slab-supporting framework, are intended to rest directly on a flat, horizontal supporting foundation, a flat, horizontal supporting studwork or joist work, or directly onto an existing flat, horizontal floor surface. The supporting frame structure comprising the first and second joists 8,12 can be levelled with the aid of wedges or like devices, and can be supported at a sufficient number of locations to obtain a continuously vertical structure.

The elongated, transversely extending second joists, of which one is referenced 12 in FIG. 4, are also provided with a plurality of second recesses 21 located at predetermined distances apart.

These transversely extending joists 12 of reduced flexural resistance are arranged to rest on the longitudinally extending first joists 8 or the foundation, and a first recess 20 in one longitudinally extending joist 8 and a second recess 21 in a transversely extending joist 12 are arranged to co-act with one another, so that the upper surface 22 of a longitudinally extending joist 8 and the upper surface 23 of a transversely extending joist 12 are located and oriented in one and the same plane.

As clearly shown in FIG. 4, the longitudinally extending first joist 8 and/or the transversely extending second joist 12 is, or are, formed with third recesses 24,25 and 26,27 respectively, forming a channeling for pipes, electrical conduits and the like. The third recesses are formed in one upper edge part of a respective joist and there form an open channel for receiving electric cables or pipes, this open channel being closed when the slabs 7 are placed on the joists.

As will be seen from FIG. 4, the longitudinally extending first joist 8 is formed in a manner which enables it to be used as a longitudinally extending joist and also as a transversely extending joist, through the agency of a second recess 28 formed in the surface 29, this second recess 28 being identical to the first recess 21 of the transversely extending joist 12.

Vertically extending channel lead-throughs can be located at any desired position on a slab. One such lead-through is shown in the illustrated slab 7'. The supporting joist structure 8,12 and the slabs 7,7',7'' are formed and constructed so that such vertical channel lead-throughs can be provided at the edge portions of the slabs and at the junctions between the intersecting joists 8,12.

Figure 8:
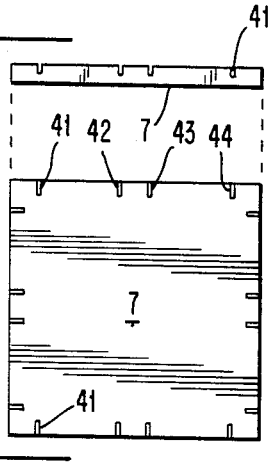
FIG. 8 is a bottom view and a side view of a second embodiment of a slab.
Figures 5, 6:
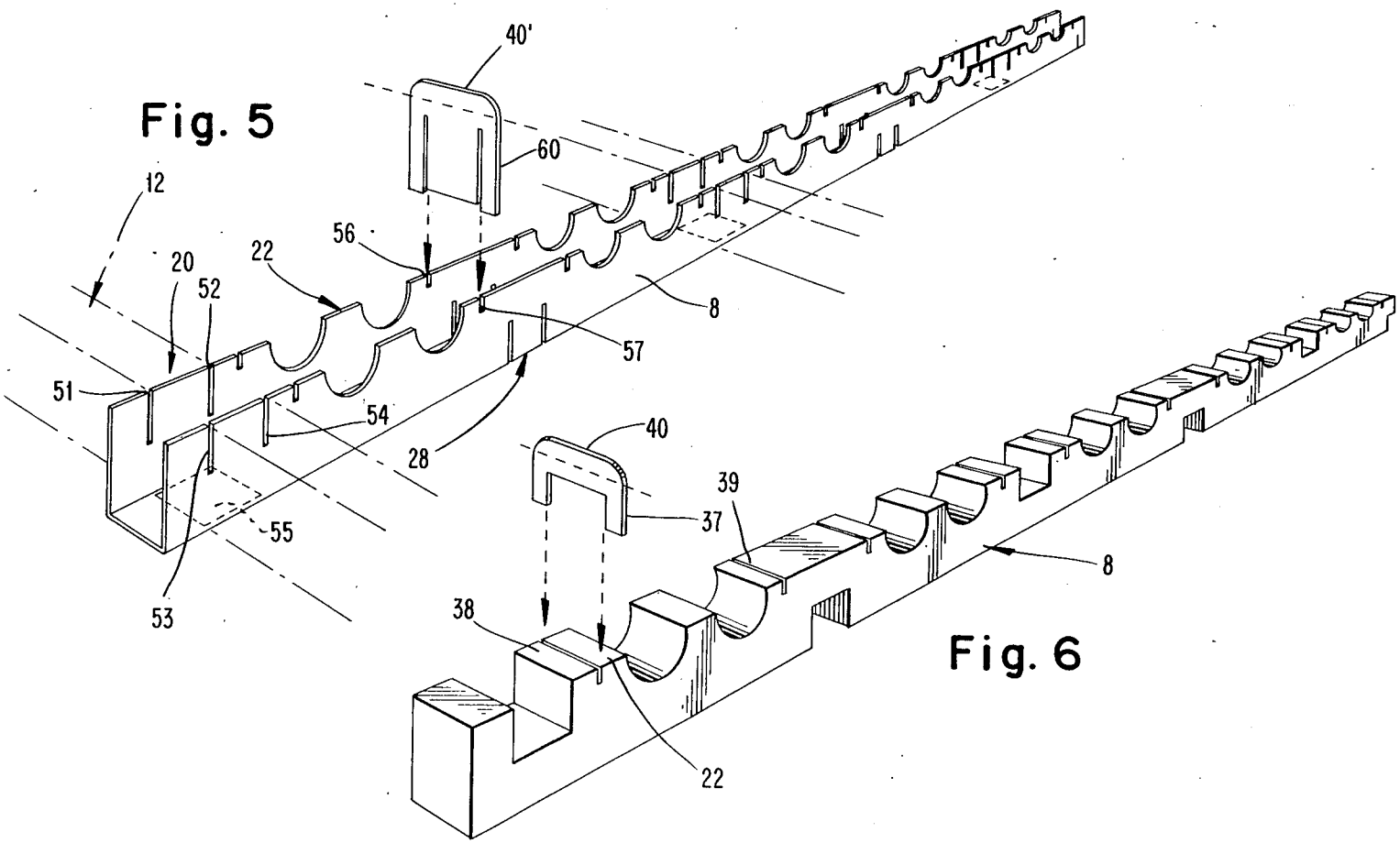
FIG. 5 illustrates a first embodiment of a joist according to the invention having a right-angled U-shaped cross-section.
FIG. 6 illustrates a second embodiment of a joist constructed in accordance with the invention.

FIG. 6 is a perspective view of a longitudinally extending joist 8 intended to co-act with a transversely extending joist. The illustrated joist 8 is provided with transverse slots 38 and 39, each of which is intended to co-act with a respective insert plate 37, wherewith a part 40 of the plate is arranged to extend above the upper surface 22 of the joist and caused to co-act with a slot 41 formed in the edge surface **7*a* of the slab 7 illustrated in FIG. 8**.

It will be readily seen that a plurality of such insert plates 37 can be used for co-action with other slots 42, 43 and 44.

FIG. 5 illustrates an embodiment in which the longitudinally extending joist 8 and the transversely extending joist 12, not shown, both have the form of a sheet-metal section of right-angled U-shaped cross-section, in which the recess 20 shown in FIG. 4 here comprises two mutually parallel slots 51,52 and 53,54 in each leg of the section. The joist 8 must be provided with a recess 55 in the bottom part thereof, in order for the upper surfaces of the longitudinally extending joist 8 and the transversely extending joist 12 to lie in one and the same plane.

The joists 8 and 12 of the FIG. 5 embodiment shall also present, to advantage further slots 56, 57 for co-action with stiffening plates 60, the upper part 40' of which, similar to the plate of FIG. 6 may be permitted to extend above the upper surface 22 in the form of two edges, for co-action with slots 41,42 in the slab 7.

Figure 9:
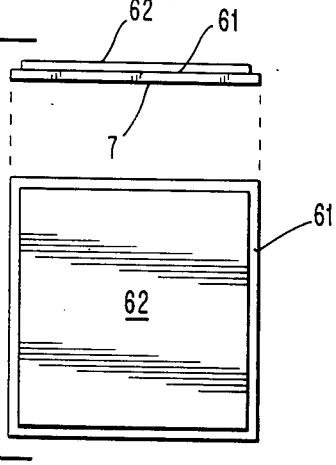
FIG. 9 is a bottom view and a side view of a third embodiment of a slab, all of which can be used in a floor construction according to the present invention.

As illustrated in FIG. 9, the means for orientating a slab in relation to its respective joists may comprise a lip or flange 61. This lip may be milled in the slab 7 or may be obtained by placing on the slab 7 a smaller metal plate 62, the lip formed being intended to rest on the edge surface of the joist 8 illustrated in FIG. 3.

Figure 7:
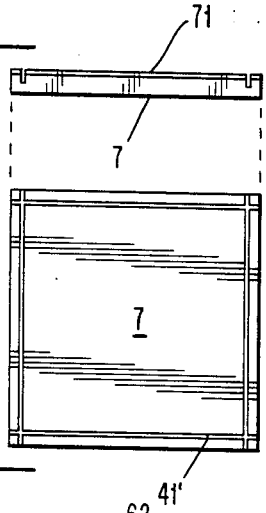
FIG. 7 is a side view and bottom view of a first embodiment of a slab.

This edge surface 22 can be caused to co-act with a groove or slot 41' in a slab 7, as shown in FIG. 7. Additionally, the undersurface of the slab 7 maybe covered with a layer 71 of metal foil, sheet metal or the like.

The invention also relates to a method of installing a floor construction suitable for rooms containing electrical switchgear, computers and like apparatus, in which method there is used a plurality of mutually parallel, elongated, longitudinally extending first joists and a plurality of mutually parallel, elongated second joists which are placed transversely, at right angles, to the first, longitudinally extending joists, and in which one or more square and/or elongate rectangular cavities defined by parts of the mutually perpendicular longitudinally extending and transversely extending joists are covered by one or more slabs forming the floor surface, these slabs being supported along their edge portions by four adjacent joist parts.

In accordance with the invention the elongated, longitudinally extending first joists, having a length which exceeds the combined length of a given number of juxtaposed slabs, are placed on a load-supporting foundation, each of the joists being provided with a plurality of upwardly facing first recesses 20 spaced at a given distance apart along said joists. The transversely extending, elongated second joists, which also have a length greater than the combined length of a given number of slabs assigned to joists 12,13, are placed at right angles to the longitudinally extending joists, each of said transverse joists being provided with mutually spaced, downwardly facing second recesses 21. The recesses are arranged to co-act with one another in a manner such that a first recess of one longitudinally extending joist will co-operate with a second recess in the transverse joist in a manner to locate the upper surfaces 22 and 23 of respective joists in one and the same horizontal plane. A right-angled slab is placed on the joists, with the four edge portions of the slab resting on the upper surfaces of half the joist, and the slab is positioned so as to co-act with locking means effective between the slab and the joists, in a manner to prevent horizontal movement of the slab along said joists and to lock the joists in a vertical position and in mutually parallel positions.

In accordance with the invention the slab-supporting framework comprising said longitudinally extending and transversely extending joists can be levelled horizontally by:

(a) placing a plurality of wedges beneath longitudinally extending and/or transversely extending joists, and/or (b) constructing a free-bearing underlying framework which is dimensioned to absorb load and the joists of which are oriented in the same manner, or substantially the same manner as the longitudinally extending and transversely extending joists of the slab-supporting framework and/or (c) smoothing out existing foundation surfaces, for example with mortar or self-levelling floor compound.

It will be understood that the invention is not restricted to the aforedescribed exemplifying embodiments, and that modifications can be made within the scope of the following claims.

I claim:

1. A floor construction, suitable for rooms having a supporting foundation and containing electrical equipment, comprising at least one right-angled slab having slab edge portions, a plurality of mutually parallel, elongated, longitudinally extending first joists and a plurality of mutually parallel, elongated second joists which are located at right angles to the first joists, said first and second joists defining at least one quadrangular cavity, said first and second joists having upper edge portions adjacent each cavity, said right-angled slab covering said cavity so as to form a floor surface, each slab supported along said slab edge portions by said upper edge portions of said first and second joist sections, the first joists provided with a plurality of first recesses spaced at a predetermined distance apart along said first joists; the second joists provided with a plurality of second recesses spaced at a predetermined distance apart along said second joists; said first and second joists each provided with third recesses for channeling pipes, electrical cables and the like, said first and third recesses reducing flexural resistance of said first joists so that said first joists are adapted to rest conformingly against a support foundation, the second and third recesses reducing flexural resistance of the second joists so that said second joists are adapted to rest conformingly agaist a supporting foundation, said first and second recesses adapted to mutually co-act so as to locate the upper edge portion of the first joist and the upper edge portion of the second joist in a common plane; at least one slab provided with means for locking the slab with said joists so that horizontal movement of the slab in said common plane is prevented, whereby said floor-structure may be locked together.

2. The floor construction according to claim 1, wherein the first joists and the second joists are identical in shape and form.

3. The floor structure according to claim 1, wherein the joists have the form of right-angled, sheet-metal sections of U-shaped cross-section, at least one of said first and second recesses each formed by two mutually opposing pairs of slots.

4. The floor construction according to claim 1, wherein the locking means provided on said slab comprises at least one of a groove extending adjacent said edge and grooves formed transversely to said edge.

5. The construction according to claim 1, wherein the under surface of the slab is covered with metal foil, sheet metal or the like.

6. The floor construction according to claim 1, wherein the locking means provided on said slab comprises a lip formed in the under surface of the edge of the slab.

7. A floor construction, suitable for rooms containing electrical equipment comprising a plurality of mutually parallel, elongated, longitudinally extending first joists and a plurality of mutually parallel, elongated second joists which are located transversely, at right angles to the first joists, said first and second joiats defining one or more square and/or rectangular cavities, said cavities being covered by one or more right-angled slabs which form the floor surface and which are arranged and dimensioned to be supported along their edge portions by upper surfaces of respective edge portions of adjacent first and second joist sections, the plurality of first joists provided with a plurality of first recesses spaced at a predetermined distance apart along said first joists; the second joists provided with a plurality of second recesses spaced at a predetermined distance apart along said second joists; said first and second joists each provided with third recesses forming channels for pipes, electrical cables and the like, said first and third recesses reducing flexural resistance of said first joists, so that said first joists are adapted to rest conformingly against a support foundation, the second and third recesses reducing the flexural resistance of the second joists so that said second joists are adapted to rest against the first joists or the supporting foundation in a manner to cause a first recess in one of the first joists to co-act with a second recess of one of the second joists in a manner to locate the upper surface of a first joist and the upper surface of a second joist in a common plane; at least one slab provided with means for locking the slab against horizontal movement in a plane relating to the upper surfaces of the joists, said locking means on said slab also being arranged to lock first and second joists in a right angled position and in mutually parallel positions;

the joists having the form of right-angled, sheet-metal sections of U-shaped cross-section, at least one of said first and second recesses each formed by two mutually opposing pairs of slots;

the joists being provided with additional slots for receiving stiffening plates or the like, said plates extending above the upper surface of respective joists to form a structural part for co-action with said locking means.

8. A floor construction, suitable for rooms containing electrical equipment comprising a plurality of mutually parallel, elongated, longitudinally extending first joists and a plurality of mutually parallel, elongated second joists which are locked transversely, at right angles to the first joists, said first and second joists defining one or more square and/or rectangular cavities, said cavities being covered by one or more right-angled slabs which form the floor surface and which are arranged and dimensioned to be supported along their edge portions by upper surfaces of respective edge portions of adjacent first and second joist sections, the plurality of first joists provided with a plurality of first recesses spaced at a predetermined distance apart along said first joists; the second joists provided with a plurality of second recesses spaced at a predetermined distance apart along said second joists; said first and second joists each provided with third recesses forming channels for pipes, electrical cables and the like said first and third recesses reducing flexural resistance of said first joists, so that said first joists are adapted to rest conformingly against a support foundation, the second and third recesses reducing the flexural resistance of the second joists so that said second joists are adapted to rest against the first joists or the supporting foundation in a manner to cause a first recess in one of the first joists to co-act with a second recess of one of the second joists in a manner to locate the upper surface of a first joist and the upper surface of a second joist in a common plane; at least one slab provided with means for locking the slab against horizontal movement in a plane relating to the upper surfaces of the joists, said locking means on said slab also being arranged to lock first and second joists in a right angled position and in mutually parallel positions;

the upper surfaces of the joists being provided with mutually parallel slots adapted to receive an insert plate which is dimensioned to extend above the upper surface of a respective joist for co-action with a groove formed in an under surface of the slab.

* * * * *